US010808469B2

(12) United States Patent
Vo

(10) Patent No.: US 10,808,469 B2
(45) Date of Patent: Oct. 20, 2020

(54) WRENCH ASSEMBLY WITH FLOATING TORQUE BODIES

(71) Applicant: FORUM US, INC, Houston, TX (US)

(72) Inventor: Han Vo, Cypress, TX (US)

(73) Assignee: FORUM US, INC., Houston, TX (US)

( * ) Notice: Subject to any disclaimer, the term of this patent is extended or adjusted under 35 U.S.C. 154(b) by 215 days.

(21) Appl. No.: 15/609,279

(22) Filed: May 31, 2017

(65) Prior Publication Data

US 2018/0347295 A1 Dec. 6, 2018

(51) Int. Cl.

| | |
|---|---|
| ***E21B 19/16*** | (2006.01) |
| ***B25B 13/50*** | (2006.01) |
| ***B25B 13/48*** | (2006.01) |

(52) U.S. Cl.

CPC ..... *E21B 19/161* (2013.01); *B25B 13/488* (2013.01); *B25B 13/5016* (2013.01); *E21B 19/163* (2013.01)

(58) Field of Classification Search

CPC ..... E21B 19/161; E21B 19/168; B25B 17/00; B25B 13/481; B25B 13/467; B25B 17/02; B25B 21/002

USPC ..... 81/57.15–57.21, 54

See application file for complete search history.

(56) References Cited

U.S. PATENT DOCUMENTS

| | | | | |
|---|---|---|---|---|
| 2,871,044 | A | 1/1959 | Peterson et al. | |
| 3,589,742 | A * | 6/1971 | Flick | E21B 19/164 269/235 |
| 3,921,473 | A | 11/1975 | Boyadjieff et al. | |
| 4,290,304 | A * | 9/1981 | Eckel | E21B 19/164 73/862.25 |
| 4,648,292 | A | 3/1987 | Haynes et al. | |
| 5,404,959 | A | 4/1995 | Adkins, Sr. et al. | |
| 6,263,763 | B1 | 7/2001 | Feigel, Jr. et al. | |
| 6,318,214 | B1 | 11/2001 | Buck | |
| 6,439,316 | B1 | 8/2002 | Penisson | |
| 7,000,503 | B2 | 2/2006 | Dagenais et al. | |
| 7,036,396 | B2 * | 5/2006 | Moe | E21B 19/168 294/194 |
| 7,188,547 | B1 * | 3/2007 | West | E21B 19/161 81/57.16 |
| 7,891,418 | B2 | 2/2011 | Begnaud et al. | |
| 7,958,787 | B2 * | 6/2011 | Hunter | E21B 19/165 73/862.21 |
| 8,074,537 | B2 * | 12/2011 | Hunter | E21B 19/168 81/57.16 |
| 8,291,791 | B2 | 10/2012 | Light et al. | |
| 8,496,238 | B1 * | 7/2013 | Orgeron | B25B 5/061 269/218 |

(Continued)

OTHER PUBLICATIONS

International Search Report and Written Opinion dated Aug. 20, 2018, Corresponding to Application No. PCT/US2018/031951.

(Continued)

*Primary Examiner* — Hadi Shakeri
*Assistant Examiner* — Marcel T Dion
(74) *Attorney, Agent, or Firm* — Patterson & Sheridan, L.L.P.

(57) ABSTRACT

A wrench assembly comprising an upper clamp assembly, a lower clamp assembly coupled to the upper clamp assembly, and an alignment device disposed between the upper and lower clamp assemblies to allow the upper clamp assembly to move laterally relative to the lower clamp assembly when rotated relative to the lower clamp assembly.

20 Claims, 11 Drawing Sheets

(56) References Cited

U.S. PATENT DOCUMENTS

| | | | | |
|---|---|---|---|---|
| 8,733,213 | B2 | 5/2014 | Taggart | |
| 10,366,507 | B2 | 7/2019 | Amezaga et al. | |
| 2001/0025551 | A1* | 10/2001 | Pietras | E21B 19/16 81/57.34 |
| 2002/0189804 | A1 | 12/2002 | Liess et al. | |
| 2008/0307930 | A1 | 12/2008 | Veverica et al. | |
| 2008/0307932 | A1 | 12/2008 | Lauzon et al. | |
| 2010/0199812 | A1 | 8/2010 | Richardson | |
| 2011/0259576 | A1 | 10/2011 | Mulder et al. | |
| 2018/0073312 | A1 | 3/2018 | Clostio, Jr. et al. | |
| 2019/0316428 | A1 | 10/2019 | Meuth et al. | |

OTHER PUBLICATIONS

European Office Action dated Jan. 10, 2020 for Application No. 18727590.4.

Gulf Cooperation Office Action dated Nov. 26, 2019 for Application No. 2018-35399.

International Search Report and Written Opinion dated Jun. 25, 2019, corresponding to Application No. PCT/US2019/025853.

Non-Final Office Action dated Jan. 31, 2020 for U.S. Appl. No. 15/952,561.

Final Office Action dated Apr. 29, 2020 for U.S. Appl. No. 15/952,561.

* cited by examiner

WRENCH ASSEMBLY WITH FLOATING TORQUE BODIES

BACKGROUND

Field

Embodiments disclosed herein relate to a wrench tool for coupling or de-coupling tubulars in a drilling or workover operation utilized in the oil and gas industry.

Description of the Related Art

A wrench tool (also known as a "tong") is commonly used in the oil and gas industry to rotate a tubular when making up or breaking out a threaded connection. The wrench tool rotates a tubular relative to another tubular to thread the tubulars together during a make-up operation, and rotates the tubular in an opposite direction to unthread the tubulars from each other during a break-out operation. A separate spinner tool may be used in conjunction with the wrench tool. The spinner tool is a relatively low torque, high speed device used for the initial makeup of a threaded connection, while the wrench tool is a relatively high torque, low speed device that is used subsequently to the spinner tool to provide a greater amount of torque to complete the threaded connection.

The wrench tool may be composed of upper and lower torque bodies having a plurality of grippers that are moved into contact with the tubulars. The upper torque body is configured to rotate one of the tubulars relative to the other tubular, which is held stationary by the lower torque body, to couple or decouple the tubulars. One problem that often occurs is the grippers grip the tubular in a position such that the center axis of the tubular is offset from the center axis of the wrench tool. This is caused when some of the grippers contact the tubular prior to the other grippers, which results in a misalignment of the wrench tool with the center axis of the tubular. The improper alignment between the wrench tool and the center axis of the tubular often results in a misapplication of the appropriate amount of torque to a threaded connection, thereby potentially resulting in a leak in the threaded connection.

Therefore, there exists a need for new and/or improved wrench tools.

SUMMARY

In one embodiment, a wrench assembly comprises an upper clamp assembly, a lower clamp assembly coupled to the upper clamp assembly, and an alignment device disposed between the upper and lower clamp assemblies, wherein the alignment device is configured to adjust an axis about which the wrench assembly applies torque by allowing the upper clamp assembly to move laterally relative to the lower clamp assembly.

In one embodiment, a wrench assembly comprises an upper clamp assembly, a lower clamp assembly coupled to the upper clamp assembly, and an alignment device disposed between the upper and lower clamp assemblies, wherein the alignment device is configured to allow the upper clamp assembly to move laterally relative to the lower clamp assembly when rotated relative to the lower clamp assembly.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include a wrench tool for making up and breaking out a threaded connection between two tubulars. The wrench tool may be used with a spinner tool. While the spinner tool is a relatively low torque, high speed device used for the initial makeup of the threaded connection, the wrench tool is a relatively high torque, low speed device that is coupled to the spinner tool and is subsequently used to provide a greater amount of torque to complete the threaded connection.

The wrench tool has a wrench assembly that includes an upper clamp assembly and a lower clamp assembly. During a make-up or break-out operation, the upper clamp assembly grips and rotates one tubular relative to another tubular, which is gripped and held stationary by the lower clamp assembly. The wrench assembly is used to apply a specified torque value to a threaded connection between two tubulars. The upper and lower clamp assemblies are at least partially laterally movable relative to each other by a torque alignment device comprising a wedge and groove engagement to account for any eccentricity between a center axis of the tubulars and a center axis of the wrench assembly. The wedge and groove engagement allows the upper clamp assembly to move laterally out of alignment with the lower clamp assembly when applying torque, and forces the upper clamp assembly body back into alignment with the lower clamp assembly after applying torque.

When the wrench assembly is applying torque to the tubulars, the torque applied is at a maximum when the center axis of the tubulars is aligned with the center axis of the wrench assembly, which is the axis about which the maximum amount of torque can be applied by the wrench assembly. Any eccentricity between the center axis of the tubulars and the axis about which torque is applied may adversely affect the actual amount of torque that is applied to the threaded connection between the tubulars. To compensate for any eccentricity between the center axis of the tubulars and the axis about which torque is applied, the upper and lower clamp assemblies of the wrench assembly are configured to move laterally relative to each other enable the torque to be applied about the center axis of the tubulars and not the center axis of the wrench assembly, thereby applying maximum torque to the threaded connection.

Figure 1:
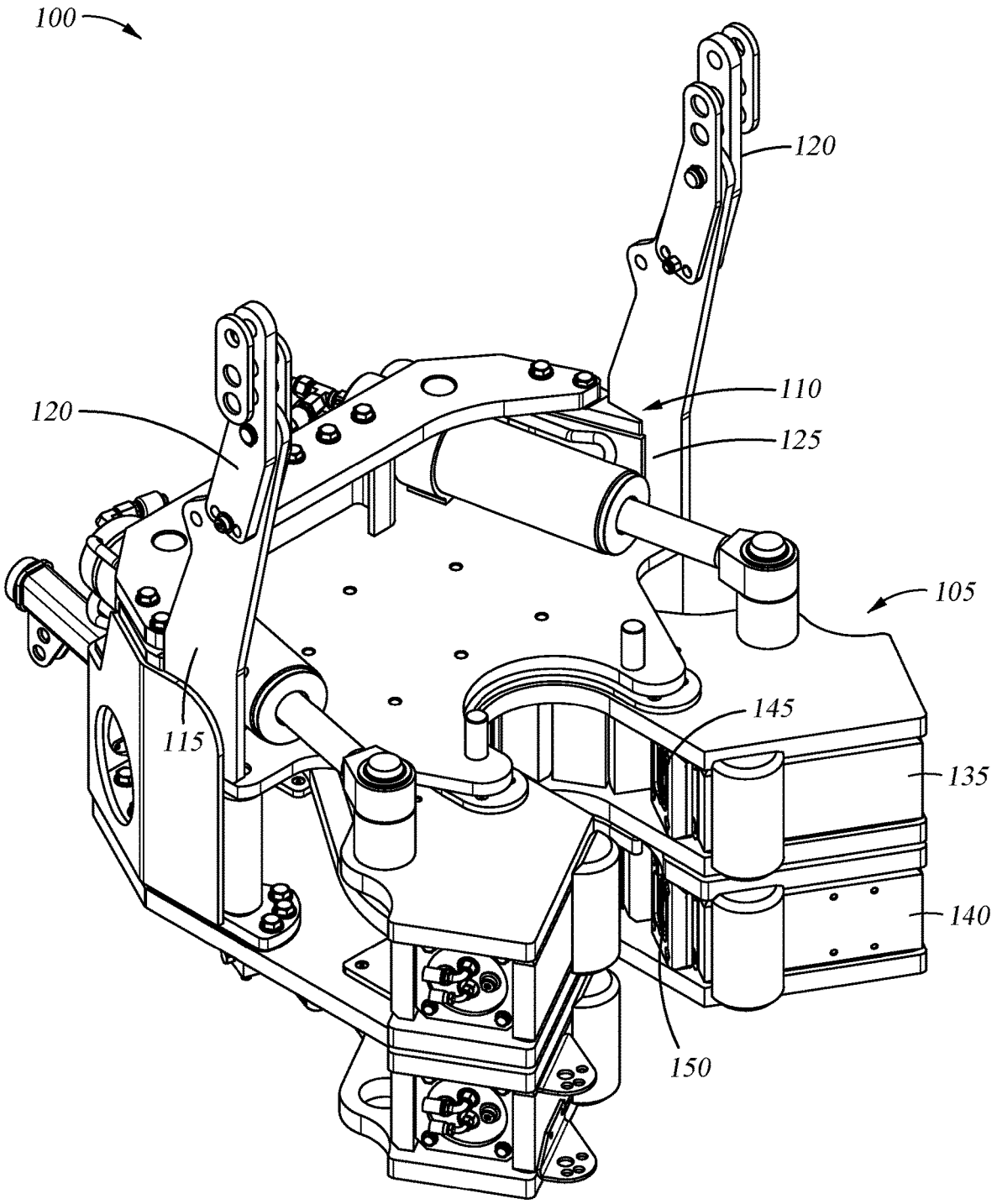
FIG. 1 is an isometric view of a wrench tool according to one embodiment.
Figure 2:
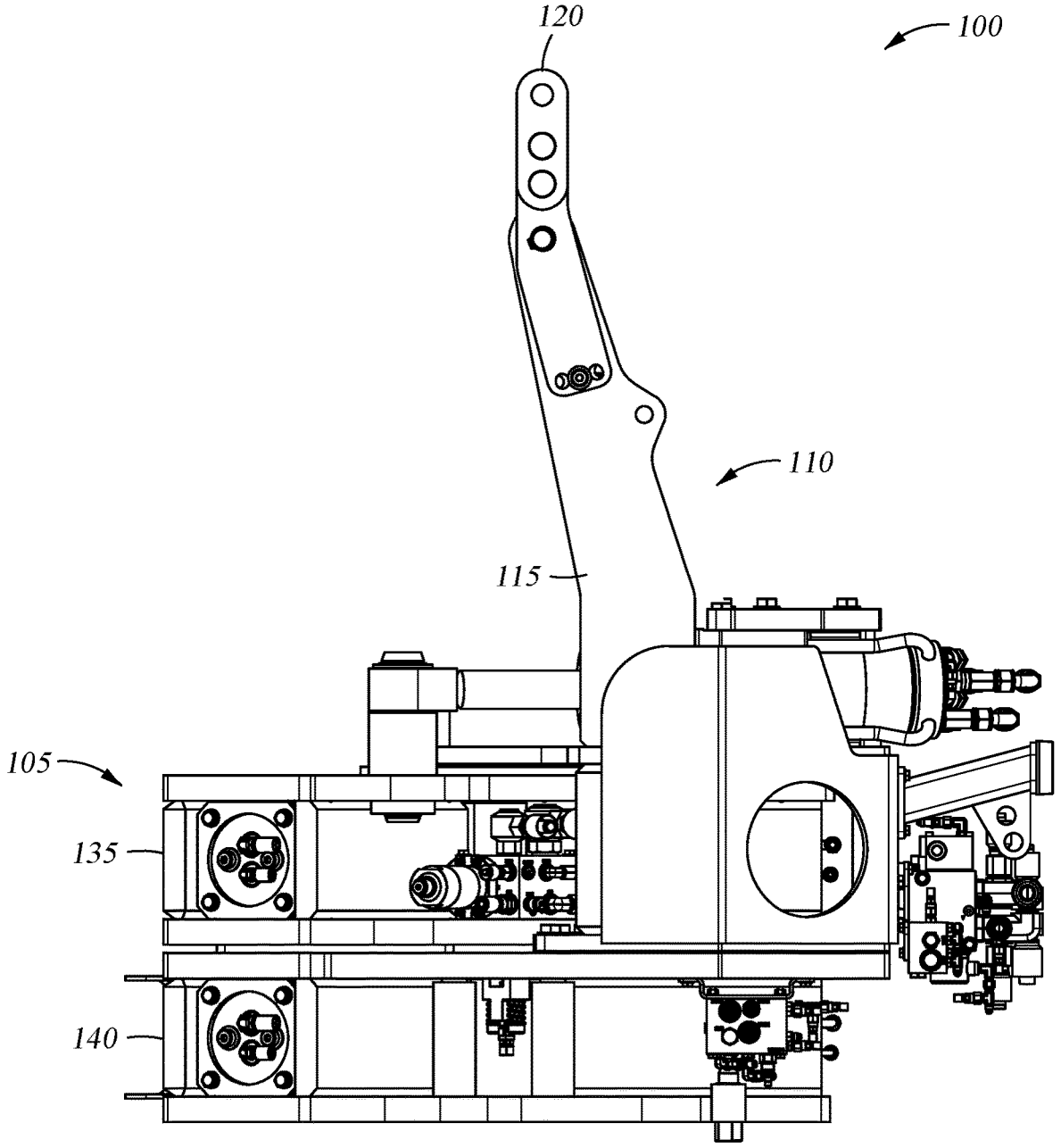
FIG. 2 is a side view of the wrench tool of FIG. 1.
Figure 3:
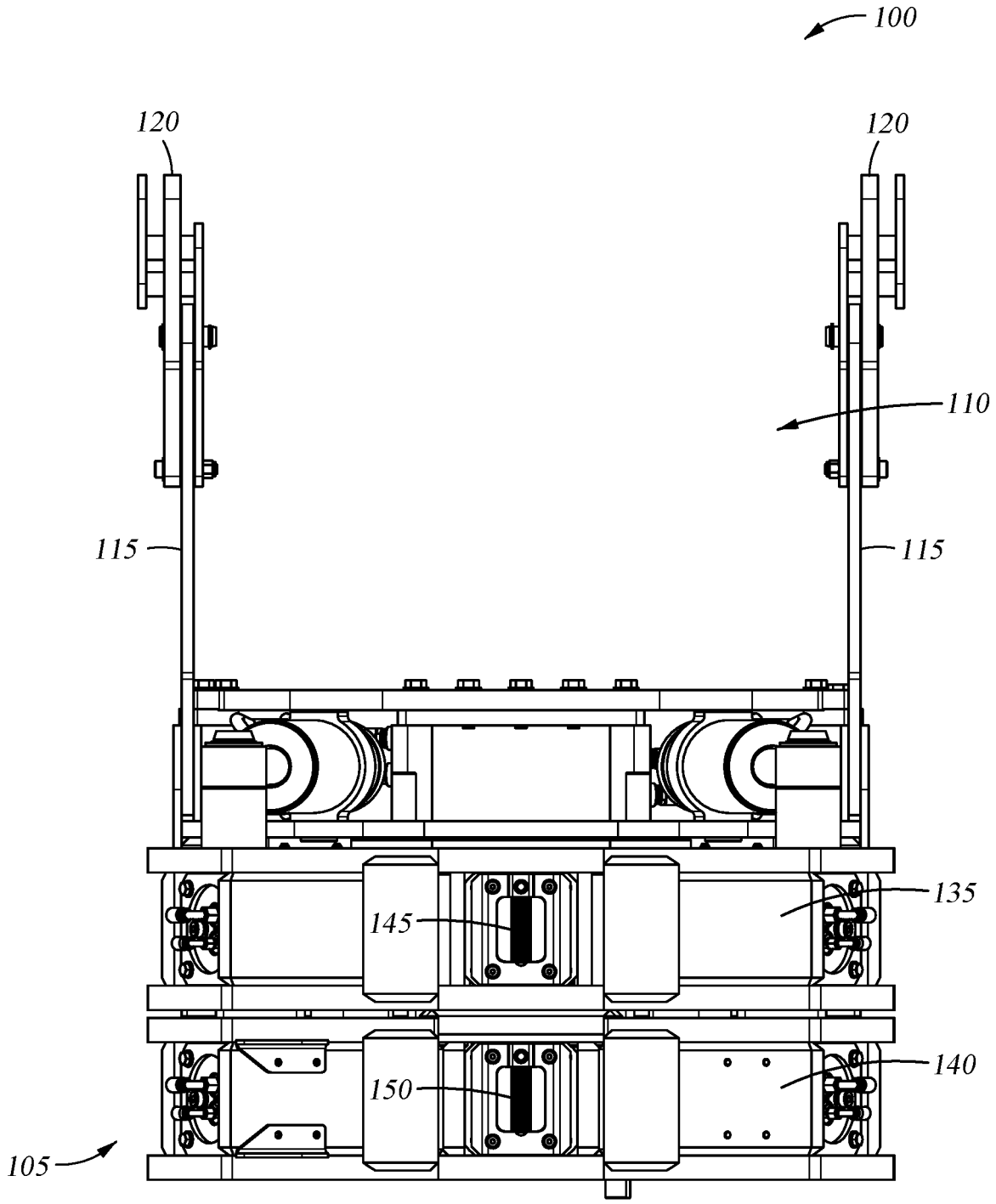
FIG. 3 is a front view of the wrench tool of FIG. 1.
Figure 4:
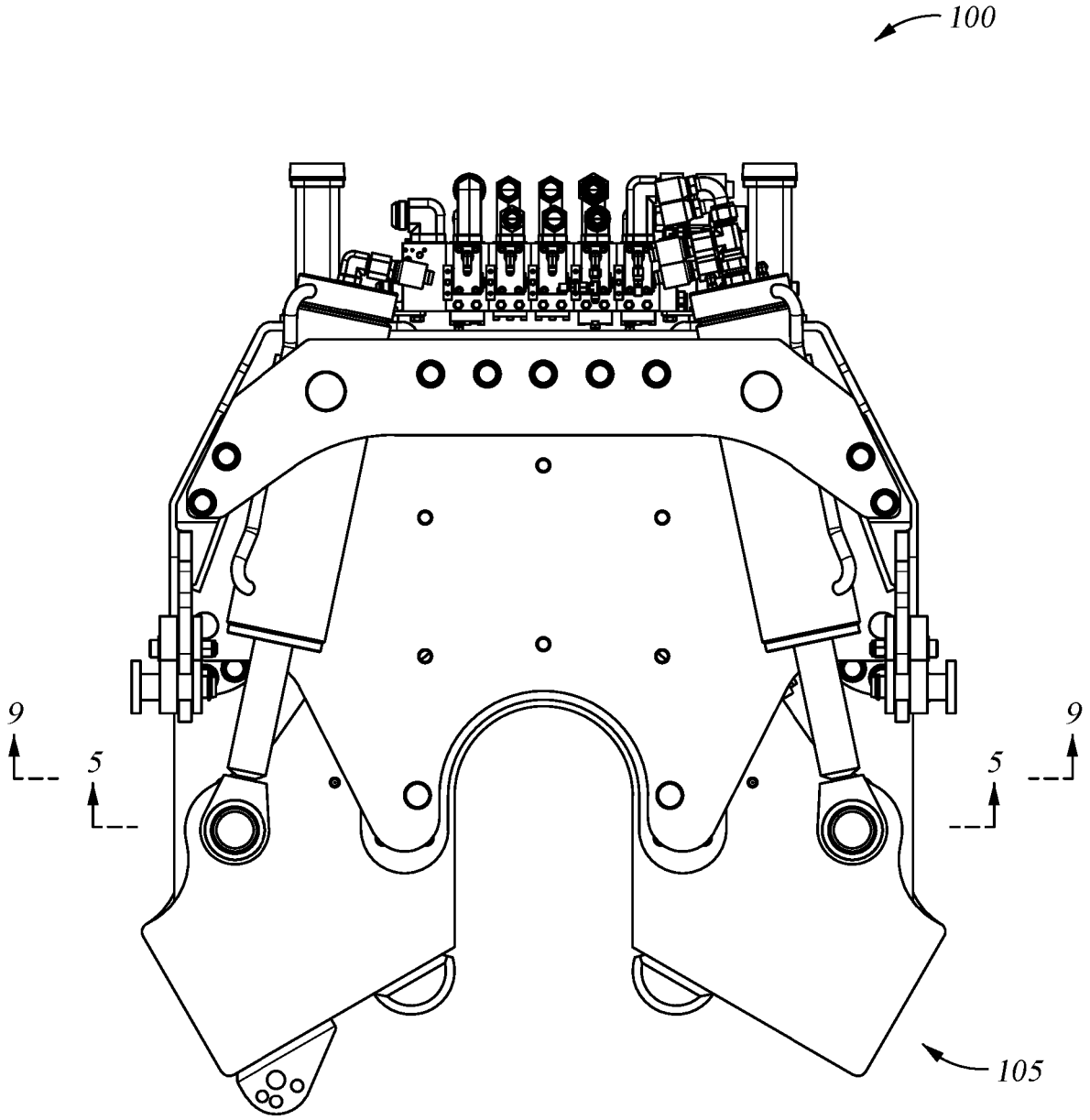
FIG. 4 is a top plan view of the wrench tool of FIG. 1.
Figure 5:
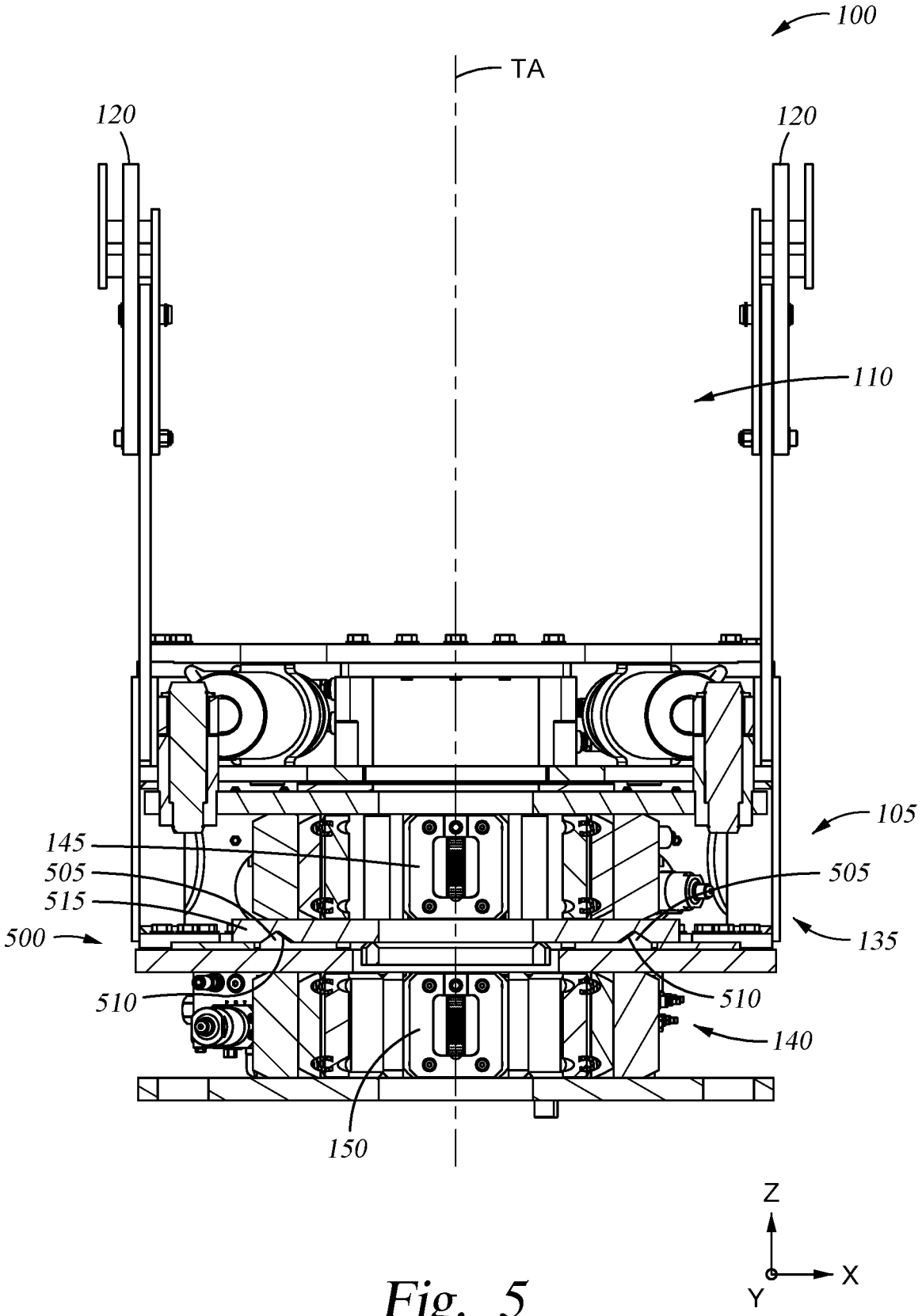
FIG. 5 is a sectional view of the wrench tool along lines 5-5 of FIG. 4.

FIGS. 1-5 are various views of one embodiment of a wrench tool 100. FIG. 1 is an isometric view of the wrench tool 100. FIG. 2 is a side view of the wrench tool 100. FIG. 3 is a front view of the wrench tool 100. FIG. 4 is a top view of the wrench tool 100. FIG. 5 is a sectional view of the wrench tool along lines 5-5 of FIG. 4.

The wrench tool 100 includes a wrench assembly 105 coupled to a support structure 115. The support structure 115 may include hangers 120 for suspending the wrench tool 100. A space 110 may be provided between the hangers 120 for a spinner tool (not shown).

The wrench assembly 105 includes an upper clamp assembly 135 and a lower clamp assembly 140. The upper clamp assembly 135 and the lower clamp assembly 140 include a plurality of grip assemblies 145 and 150, respectively (some are shown in FIGS. 1 and 3). The grip assemblies 150 of the lower clamp assembly 140 may be used to grip a box end of a first tubular, and the grip assemblies 145 of the upper clamp assembly 135 may be used to grip a pin end of a second tubular.

In a make-up operation, the wrench tool 100 is brought into proximity with a first tubular that is held by a rotary spider on a rig floor for example. The grip assemblies 150 of the lower clamp assembly 140 are actuated to grip the box end of the first tubular. A pin end of a second tubular is positioned on top of the box end of the first tubular, for example by an elevator or top drive (not shown).

The second tubular is rotated by a spinner tool (not shown) to initially make up the threaded connection between the tubulars. After the initial make up, the grip assemblies 145 of the upper clamp assembly 135 are actuated into contact with the pin end of the second tubular, while the box end of the first tubular remains gripped by the lower clamp assembly 140. The upper clamp assembly 135 then is rotated relative to the lower clamp assembly 140 to further tighten the threads between the first and second tubulars.

In the event that the center axis of the tubulars when gripped by the grip assemblies 145, 150 is offset from the center axis of the wrench assembly 100 (identified by axis TA of the wrench tool 100 shown in FIG. 5), which is the axis about which torque is normally applied, the upper clamp assembly 135 is configured to move laterally relative to the lower clamp assembly 140 so that the torque can be applied about the center axis of the tubulars as further described below.

The wrench tool 100 includes an alignment device 500 configured to adjust the axis about which the wrench assembly 105 applies torque by allowing the upper clamp assembly 135 to move laterally relative to the lower clamp assembly 140. The alignment device 500 enables the upper clamp assembly 135 to move to a position out of alignment with the lower clamp assembly 140 to apply torque about an axis that is aligned with the center axis of the tubulars, which may not be along the axis TA of the wrench tool 100 but instead is offset from the axis TA of the wrench tool 100. After the torque is applied, the alignment device 500 forces the upper clamp assembly 135 back into alignment with the lower clamp assembly 140.

Figure 6:
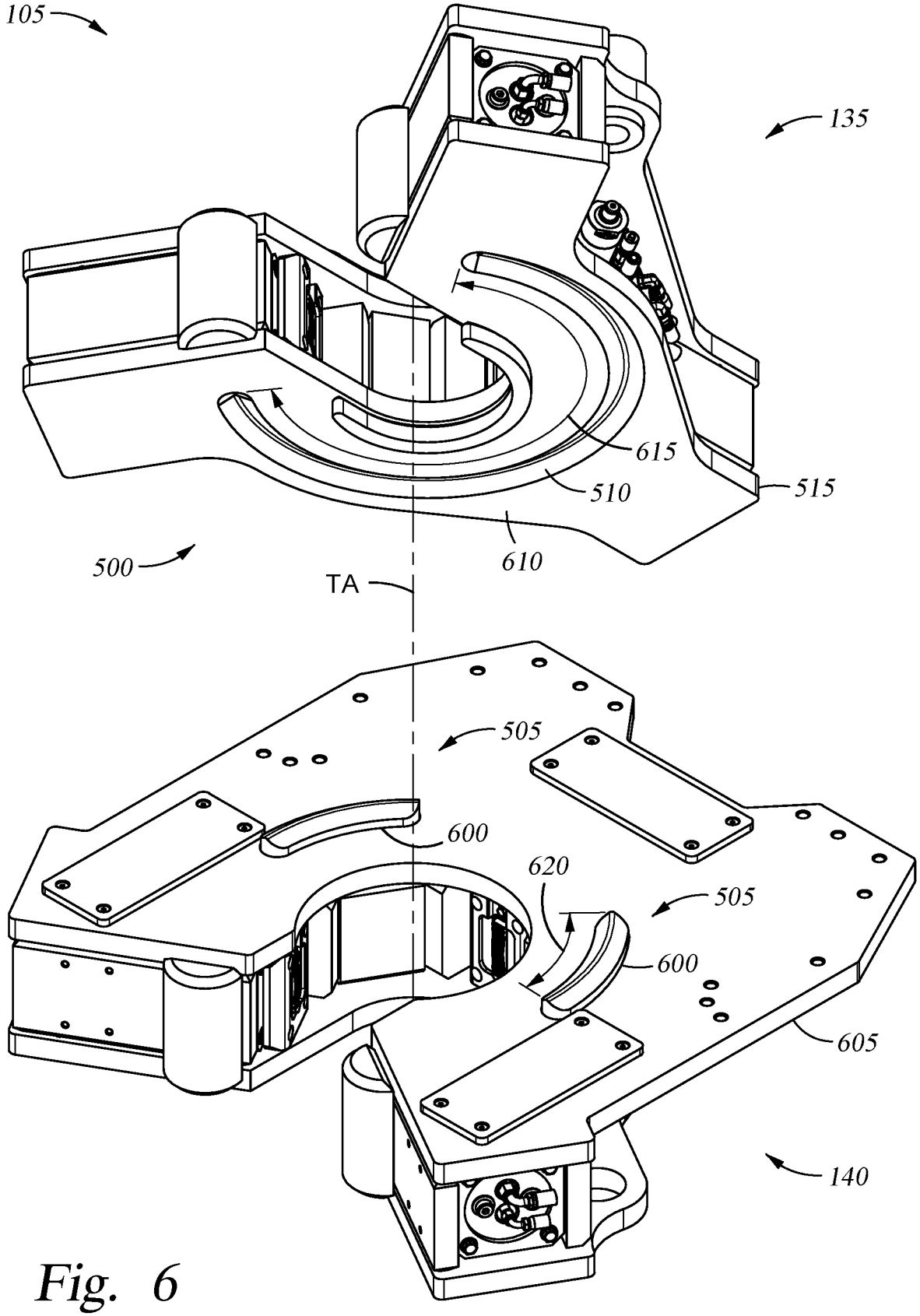
FIG. 6 is an isometric exploded view of the wrench tool.

As shown in FIGS. 5 and 6, the alignment device 500 includes one or more wedges 505 formed on the lower clamp assembly 140 that contact a groove 510 formed on the upper clamp assembly 135. The wedges 505 are disposed through an upper plate member 605 of the lower clamp assembly 140. The groove 510 is formed in a lower plate member 515 of the upper clamp assembly 135.

The tapered surfaces of the wedges 505 engage the tapered surfaces of the groove 510 such that the upper clamp assembly 135 can move laterally in the X and/or Y directions into and out of alignment with the lower clamp assembly 140. When torque is applied by the wrench assembly 105, the upper clamp assembly 135 (which is gripping the upper tubular) is rotated relative to the lower clamp assembly 140 (which is gripping the lower tubular). As the upper clamp assembly 135 rotates relative to the lower clamp assembly 140, if the center axis of the tubular is offset from the center axis of the wrench assembly 105, then the tapered surfaces of the groove 510 forces the wedges 505 downwardly (in at least the Z direction) to allow the upper clamp assembly 135 to move laterally (in at least the X and/or Y directions) relative to the lower clamp assembly 140 to apply torque about the center axis of the tubulars. After the torque is applied, the wedges 505 are biased upward so that the tapered surfaces of the wedges 505 force the upper clamp assembly 135 back into alignment with the lower clamp assembly 140.

FIG. 6 is an isometric exploded view of the wrench assembly 105 that clearly shows the wedges 505 and the groove 510. Each of the wedges 505 extend up through an opening 600 formed in the upper plate member 605 of the lower clamp assembly 140. Each of the wedges 505 are biased toward the upper clamp assembly 135 by a biasing member, such as a spring 805 shown in FIG. 8. The groove 510 is formed as a recess in a surface 610 of the lower plate member 515 of the upper clamp assembly 135. Each of the groove 510 and the wedges 505 are curved and shaped as an arc. The groove 510 may include an arc length 615 that is greater than an arc length 620 of each of the wedges 505. The curved shape of the groove 510 and the wedges 505 allows relative rotation between the lower clamp assembly 140 and the upper clamp assembly 135. In an alternative embodiment, the wedges 505 can be disposed through the upper clamp assembly 135 and the groove 510 can be located on the lower clamp assembly 140.

Figure 7:
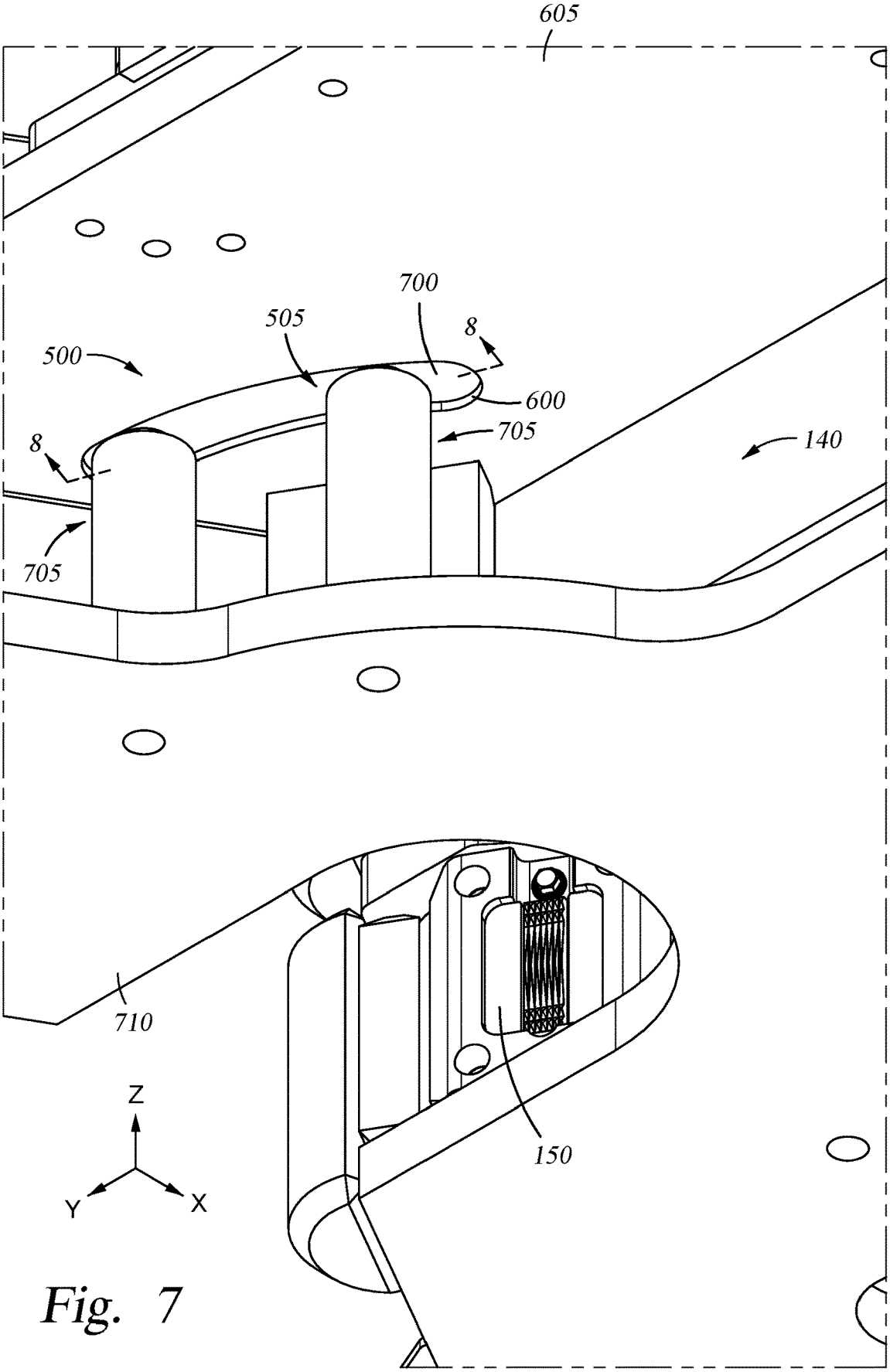
FIG. 7 is an isometric bottom view of a portion of the wrench tool.

FIG. 7 is an isometric bottom view of a portion of the lower clamp assembly 140 showing a bottom surface 700 of one of the wedges 505. A biasing assembly 705 is coupled between the bottom surface 700 of the wedge 505 and a lower plate member 710 of the lower clamp assembly 140. The biasing assembly 705 biases the wedges 505 upward toward the upper clamp assembly 135.

Figure 8:
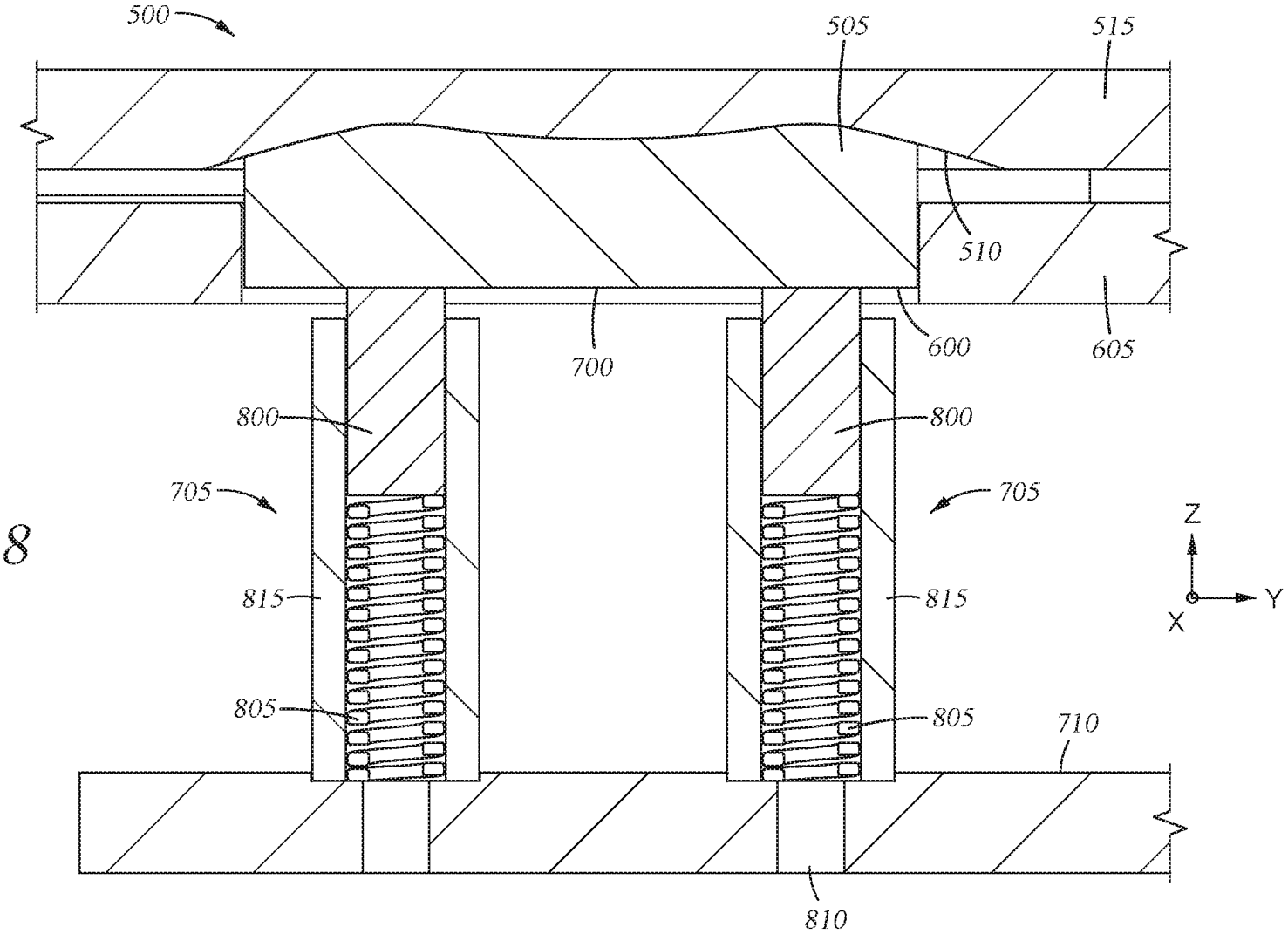
FIG. 8 is a sectional view of a portion of the wrench tool taken along lines 8-8 of FIG. 7.

FIG. 8 is a sectional view of a portion of the alignment device 500 along lines 8-8 of FIG. 7. As shown in FIG. 8, the wedge 505 is biased upwardly into contact with the groove 510 by two biasing assemblies 705, each of which includes a pin 800 and a spring 805. The spring 805 may be supported by a support member 810 (e.g. such as another pin) that is coupled to the lower plate member 710. A cylindrical cover 815 may at least partially enclose the pin 800 and the spring 805. The biasing assembly 705 allows the wedge 505 to be moved downward relative to the upper plate member 605 of the lower clamp assembly 140 in the Z direction, thereby compressing the spring 805.

Figure 9:
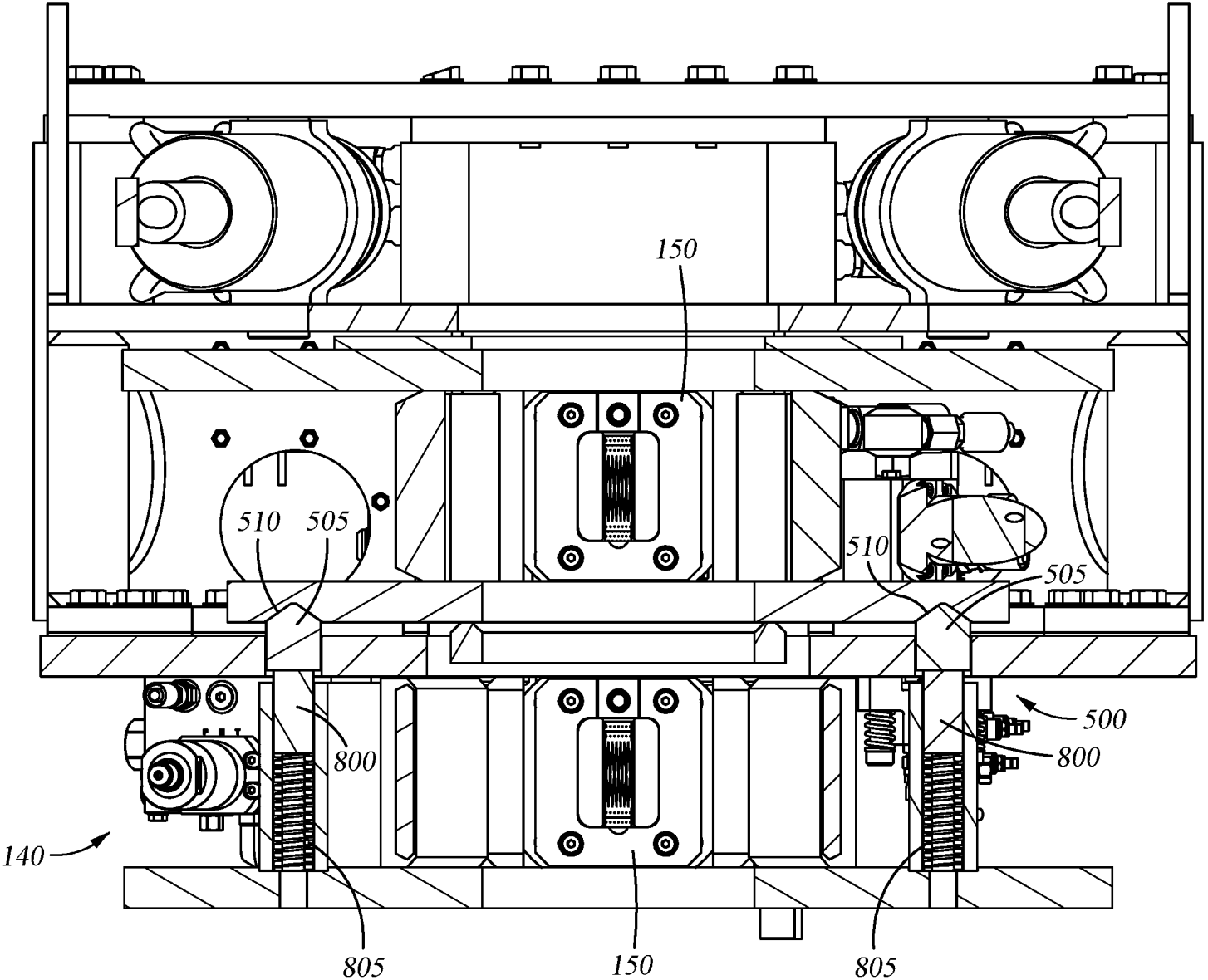
FIG. 9 is a sectional view of a portion of the wrench tool taken along lines 9-9 of FIG. 4.
Figure 10:
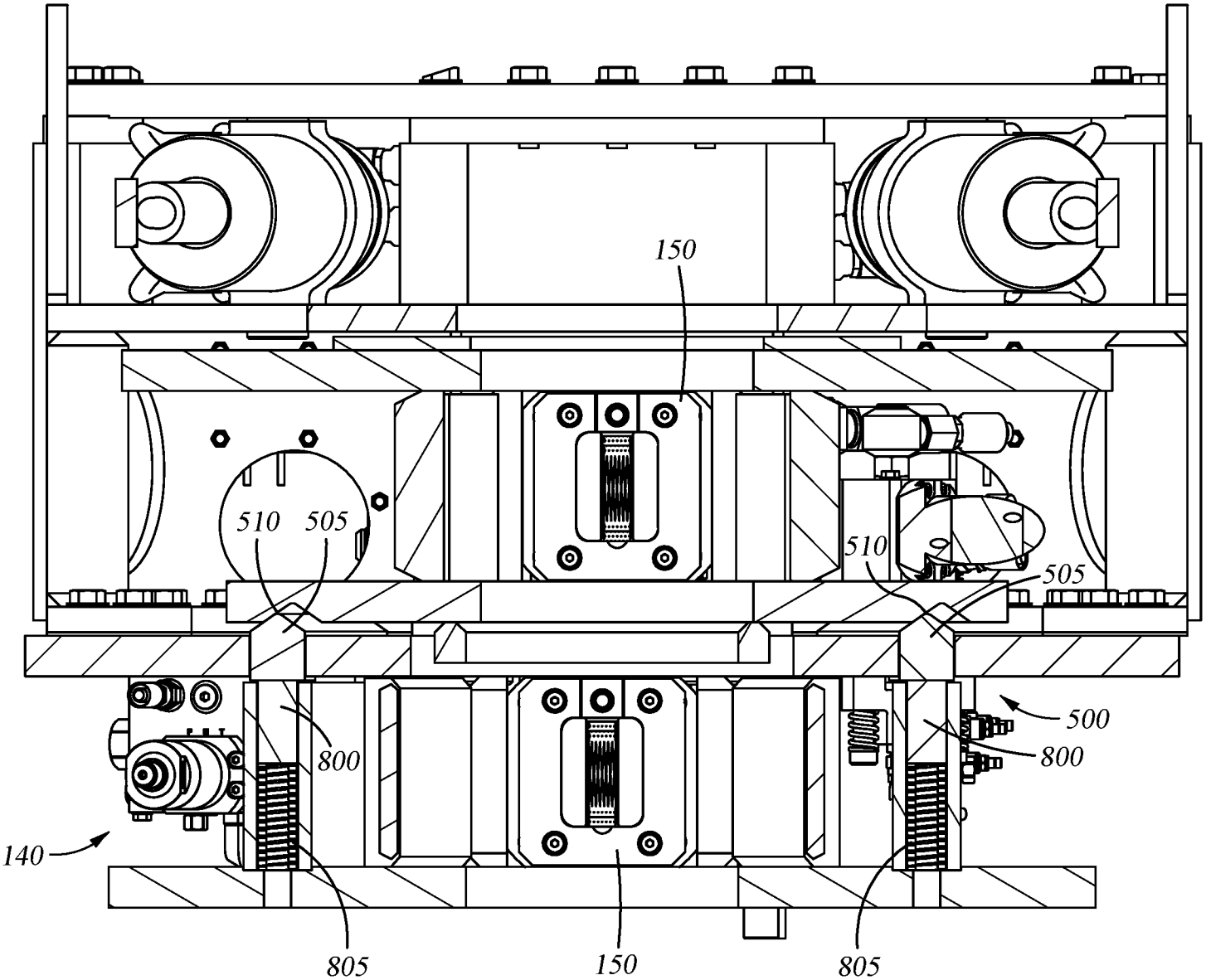
FIG. 10 is a sectional view of the portion of the wrench tool shown in FIG. 9 in an operating position different than the position shown in FIG. 9.

FIG. 9 is a sectional view of the wrench assembly 105 along lines 9-9 of FIG. 4, and FIG. 10 is the sectional view of FIG. 9 but in a different position to illustrate the operation of the alignment device 500. FIG. 9 is a sectional view of a portion of the alignment device 500 in a first position where the upper clamp assembly 135 is in alignment with the lower clamp assembly 140 such that the wedges 505 are centrally positioned within the groove 510. FIG. 10 is a sectional view of the same portion of the alignment device 500 as shown in FIG. 9 but in a second position where the upper clamp assembly 135 has moved laterally relative to the lower clamp assembly 140 such that the tapered surface of the groove 510 has forced the wedges 505 downwardly. After release of the tubulars by the upper clamp assembly 135, the springs 805 and the pins 800 force the tapered surface of the wedges 505 up against the tapered surface of the groove 510 to force the upper clamp assembly 135 back into alignment with the lower clamp assembly 140 as shown in FIG. 9.

Figure 11A:
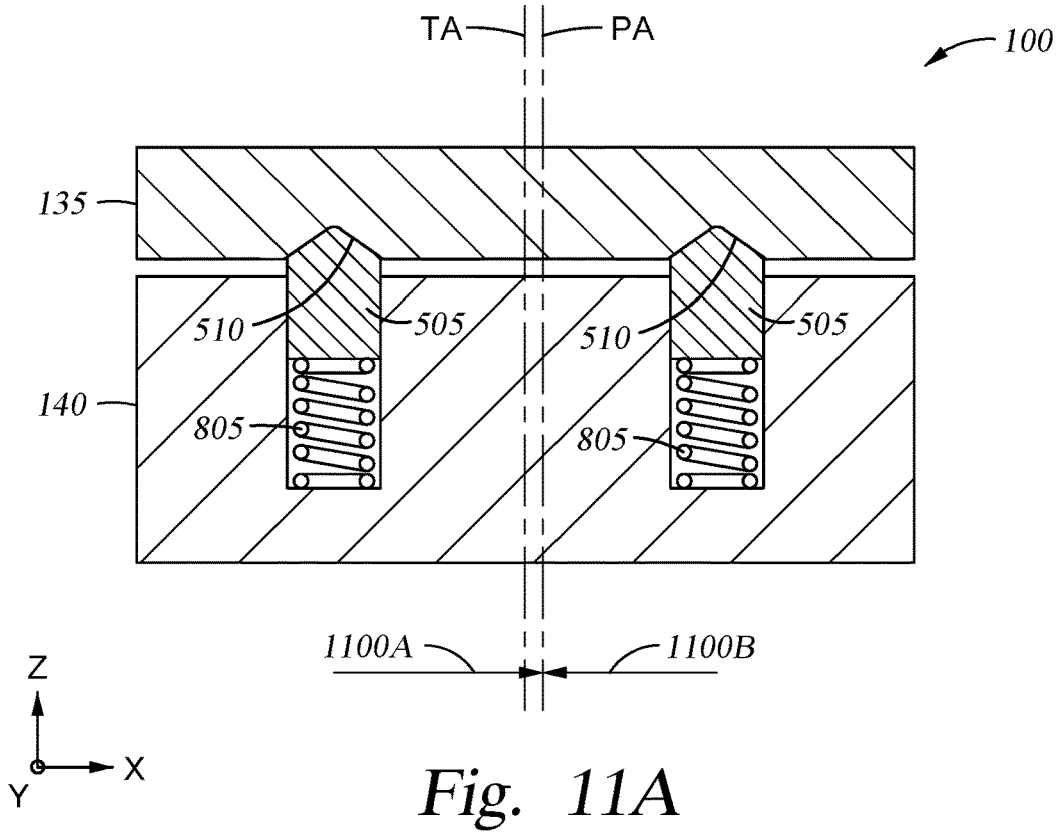
FIGS. 11A and 11B are schematic representations of the wrench tool in a pre-torque position and a torque application position, respectively.
Figure 11B:
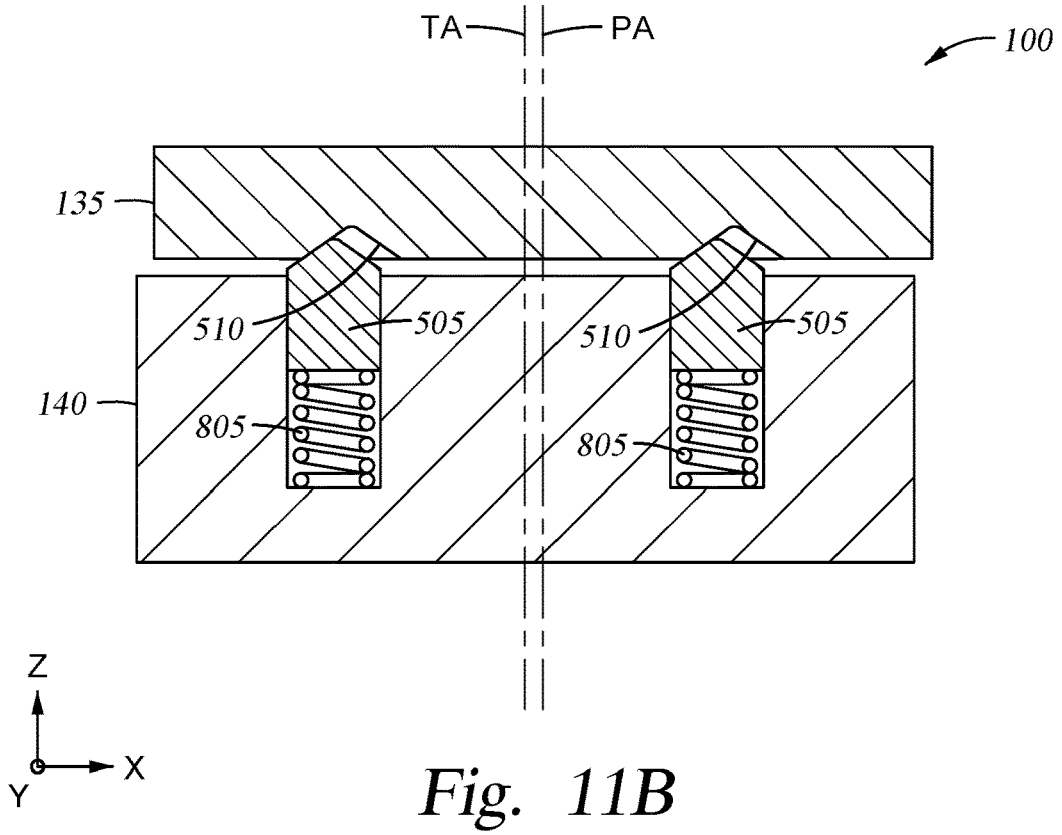

FIGS. 11A and 11B are schematic representations of the wrench tool 100 in a pre-torque position and a torque application position, respectively, when the center axis PA of a tubular is offset from the center axis TA of the wrench tool 100. As shown in FIG. 11A and FIG. 11B, the axis PA is not aligned with the axis TA. The misalignment of the center axis PA of the tubular relative to the center axis TA of the wrench tool 100 may occur by, for example, the grip assemblies 150 that push the tubular out of alignment with the axis TA during initial gripping of the tubular.

While the misalignment of the center axis TA and the center axis PA is exaggerated in FIGS. 11A and 11B, the wrench tool 100 as disclosed herein may adjust for this misalignment. For example, as shown in FIG. 11B, the alignment device 500, consisting of the groove 510 and one or more wedges 505 biased by springs 805, allows the wrench assembly 105 to shift laterally and rotate about the center axis PA during torque application as described above. The torque alignment includes lateral movement of the upper clamp assembly 135 relative to the lower clamp assembly 140 in the X and/or Y directions, as well as movement of the wedges 505 forced downward in the Z direction against the bias of and compressing the springs 805. Upon release of the tubular, the springs 805 force the wedges 505 back up against the groove 510 to re-center the upper clamp assembly 135 with the lower clamp assembly 140 as shown in FIG. 11A.

While the foregoing is directed to embodiments of the disclosure, other and further embodiments of the disclosure thus may be devised without departing from the basic scope thereof, and the scope thereof is determined by the claims that follow.

The invention claimed is:

1. A wrench assembly, comprising;

an upper clamp assembly comprising an upper plate and a lower plate;

a lower clamp assembly coupled to the upper clamp assembly, the lower clamp assembly comprising an upper plate and a lower plate, wherein the upper plate of the lower clamp assembly is below the lower plate of the upper clamp assembly; and an alignment device disposed between the upper and lower clamp assemblies, wherein the alignment device is configured to allow the upper clamp assembly to move laterally offset from the lower clamp assembly when rotated relative to the lower clamp assembly, the alignment device comprising:

a wedge disposed at least partially in an opening formed in an upper surface of the upper plate of the lower clamp assembly and at least partially in a groove formed in a lower surface of the lower plate of the upper clamp assembly.

2. The wrench assembly of claim 1, wherein the groove forms one or more tapered surfaces of the lower plate of the upper clamp assembly, and the wedge engages the one or more tapered surfaces of the groove.

3. The wrench assembly of claim 1, wherein the wedge has an arcuate shape and an arc length along the upper surface of the upper plate of the lower clamp assembly, and the groove formed in the lower surface of the lower plate of the upper clamp assembly has an arcuate shape and an arc length along the lower surface of the lower plate of the upper clamp assembly, wherein the arc length of the groove formed in the lower surface of the lower plate of the upper clamp assembly is greater than the arc length of the wedge.

4. The wrench assembly of claim 2, wherein the wedge is biased into engagement with the one or more tapered surfaces of the groove.

5. The wrench assembly of claim 2, wherein the wedge is coupled to a spring that biases the wedge into the groove, and the spring is disposed between the upper plate of the lower clamp assembly and the lower plate of the lower clamp assembly.

6. The wrench assembly of claim 5, wherein the spring is engaged with a pin that aligns the wedge.

7. The wrench assembly of claim 6, wherein the spring and the pin are at least partially housed within a cylindrical cover.

8. The wrench assembly of claim 1, wherein the alignment device comprises a second wedge configured to engage with the groove formed in the lower surface of the lower plate of the upper clamp assembly.

9. The wrench assembly of claim 8, wherein each of the wedges and the groove have an arcuate shape and an arc length.

10. The wrench assembly of claim 1, wherein the alignment device is configured to allow the upper clamp assembly to move laterally relative to a center axis of the wrench assembly when rotated relative to the lower clamp assembly, and the wedge is movable upwardly and downwardly.

11. A wrench assembly, comprising;

an upper clamp assembly comprising an upper plate and a lower plate;

a lower clamp assembly coupled to the upper clamp assembly, the lower clamp assembly comprising an upper plate and a lower plate, wherein the upper plate of the lower clamp assembly is below the lower plate of the upper clamp assembly; and an alignment device disposed between the upper and lower clamp assemblies, wherein the alignment device is configured to adjust an axis about which the wrench assembly applies torque by allowing the upper clamp assembly to move laterally offset from the lower clamp assembly, the alignment device comprising:

a wedge disposed at least partially in an opening formed in an upper surface of the upper plate of the lower clamp assembly and at least partially in a groove formed in a lower surface of the lower plate of the upper clamp assembly.

12. The wrench assembly of claim 11, wherein the wedge is movable relative to the upper plate of the lower clamp assembly.

13. The wrench assembly of claim 11, wherein the wedge has an arcuate shape and an arc length along the upper surface of the upper plate of the lower clamp assembly, and the groove formed in the lower surface of the lower plate of the upper clamp assembly has an arcuate shape and an arc length along the lower surface of the lower plate of the upper clamp assembly, wherein the arc length of the groove formed in the lower surface of the lower plate of the upper clamp assembly is greater than the arc length of the wedge.

14. The wrench assembly of claim 11, wherein the groove forms one or more tapered surfaces of the lower plate of the upper clamp assembly, and the wedge is biased into engagement with the one or more tapered surfaces of the groove.

15. The wrench assembly of claim 14, wherein the wedge is coupled to a spring that biases the wedge into the one or more tapered surfaces the groove, and the spring is disposed between the upper plate of the lower clamp assembly and the lower plate of the lower clamp assembly.

16. The wrench assembly of claim 15, wherein the spring is engaged with a pin that aligns the wedge.

17. The wrench assembly of claim 16, wherein the spring and the pin are at least partially housed within a cylindrical cover.

18. The wrench assembly of claim 11, wherein the alignment device comprises a second wedge configured to engage with the groove formed in the lower surface of the lower plate of the upper clamp assembly.

19. The wrench assembly of claim 18, wherein each of the wedges and the groove have an arcuate shape and an arc length.

20. A wrench assembly, comprising;

a center axis;

an upper clamp assembly comprising an upper plate and a lower plate;

a lower clamp assembly coupled to the upper clamp assembly, the lower clamp assembly comprising an upper plate and a lower plate, wherein the upper plate of the lower clamp assembly is below the lower plate of the upper clamp assembly; and an alignment device disposed between the upper and lower clamp assemblies, wherein the alignment device is configured to allow the upper clamp assembly to move laterally relative to the center axis when rotated relative to the lower clamp assembly, the alignment device comprising:

a wedge disposed at least partially in an opening formed in an upper surface of the upper plate of the lower clamp assembly and at least partially in a groove formed in a lower surface of the lower plate of the upper clamp assembly.

* * * * *